US011162285B2

(12) United States Patent
Fouts et al.

(10) Patent No.: US 11,162,285 B2
(45) Date of Patent: Nov. 2, 2021

(54) DOOR HINGE

(71) Applicant: Lovevery, Inc., Boise, ID (US)

(72) Inventors: Philip J. Fouts, Boise, ID (US); Thomas Creason Rigby, Boise, ID (US)

(73) Assignee: Lovevery, Inc., Boise, ID (US)

( * ) Notice: Subject to any disclaimer, the term of this patent is extended or adjusted under 35 U.S.C. 154(b) by 309 days.

(21) Appl. No.: 16/399,810

(22) Filed: Apr. 30, 2019

(65) Prior Publication Data

US 2020/0347654 A1 Nov. 5, 2020

(51) Int. Cl.

| | |
|---|---|
| ***E05D 1/00*** | (2006.01) |
| ***E05D 5/02*** | (2006.01) |
| ***E05F 1/12*** | (2006.01) |
| *A63H 33/10* | (2006.01) |

(52) U.S. Cl.

CPC ..... *E05D 1/00* (2013.01); *E05D 5/023* (2013.01); *E05F 1/12* (2013.01); *A63H 33/103* (2013.01); *E05Y 2201/41* (2013.01); *E05Y 2600/526* (2013.01); *E05Y 2800/678* (2013.01); *E05Y 2900/60* (2013.01)

(58) Field of Classification Search

CPC ..... A63H 33/103; E05D 1/00; E05D 5/023; E06B 2003/7046

USPC ..... 446/104, 120; 16/225, 226, 227; 49/398

See application file for complete search history.

(56) References Cited

U.S. PATENT DOCUMENTS

| | | | | | |
|---|---|---|---|---|---|
| 1,276,174 | A * | 8/1918 | Carter | E05D 1/02 | 16/225 |
| 1,843,170 | A * | 2/1932 | Meldrim | E05D 1/02 | 16/227 |
| 2,253,606 | A * | 8/1941 | Boltz | D06F 57/08 | 16/225 |
| 4,488,373 | A * | 12/1984 | Glickson | A63H 33/103 | 446/4 |

(Continued)

FOREIGN PATENT DOCUMENTS

| | | |
|---|---|---|
| DE | 4244158 | 6/1994 |
| ES | 145354 | 2/1969 |

(Continued)

OTHER PUBLICATIONS

International Search Report and Written Opinion in International Application No. PCT/US2020/030444, dated Sep. 18, 2020, 12 pages.

*Primary Examiner* — Jeffrey O'Brien
(74) *Attorney, Agent, or Firm* — Fish & Richardson P.C.

(57) ABSTRACT

A door hinge assembly includes: a door frame defining a frame opening and a jamb at one side of the frame opening, the jamb including two frame corners protruding into the frame opening and a jamb brace connecting the two frame corners across the frame opening, the jamb brace defining two spaced-apart hinge holes therethrough; a door movable to selectively provide access through the frame opening, and an elastic cord connecting the door to the door frame, the cord extending sequentially through a first of the two hinge passages, through a first of two passage openings at the jamb edge, through a first of the two hinge holes, across the jamb brace, through a second of the two hinge holes, through a second of the two passage openings at the jamb edge, and through the second of the two hinge passages.

9 Claims, 6 Drawing Sheets

(56) References Cited

U.S. PATENT DOCUMENTS

| | | | | | |
|---|---|---|---|---|---|
| 4,619,304 | A * | 10/1986 | Smith | G09F 15/0068 | 160/135 |
| 4,731,962 | A * | 3/1988 | Kittner | A63H 33/103 | 135/121 |
| 5,048,585 | A * | 9/1991 | Miller | E04B 2/7429 | 160/135 |
| 5,302,148 | A * | 4/1994 | Heinz | A63F 9/088 | 273/153 S |
| 5,372,450 | A * | 12/1994 | Blodgett | A63H 33/10 | 403/171 |
| 5,688,604 | A * | 11/1997 | Matan | A63H 33/103 | 428/542.2 |
| 5,952,637 | A * | 9/1999 | Strunk | A63F 3/0023 | 235/90 |
| 6,482,063 | B1 * | 11/2002 | Frigard | A63H 3/16 | 446/119 |
| 7,900,878 | B2 * | 3/2011 | Perez-Sanchez | B64C 9/02 | 244/219 |
| 10,752,330 | B2 * | 8/2020 | Smithson | B64D 11/02 | |
| 2004/0168776 | A1 * | 9/2004 | Murray | A63H 33/103 | 160/135 |
| 2019/0291843 | A1 * | 9/2019 | Smithson | B64D 11/02 | |
| 2019/0292814 | A1 * | 9/2019 | Smithson | E05D 7/009 | |

FOREIGN PATENT DOCUMENTS

| | | |
|---|---|---|
| GB | 2135896 | 9/1984 |
| GB | 2257198 | 1/1993 |

* cited by examiner

DOOR HINGE

TECHNICAL FIELD

This invention generally relates to door hinge assemblies, and more particularly to hinges for doors intended to be opened by young children, such as on toys.

BACKGROUND

Doors and door hinge assemblies are often found in many childhood toys and products, such as toy boxes, intended to be used by children over the age of three. The United States Consumer Product Safety Commission (CPSC) issues restrictions on toys with components below a certain size and intended for use by children under three years old, as they may present a choking, aspiration, or ingestion hazard. These restrictions apply to any small part that could come loose during normal or reasonable foreseeable use. Improvements in the design, configuration, and safety of children's toys, and the components that make up such toys, are continually sought.

SUMMARY

One aspect of the present invention features a door hinge assembly having a door frame, a door, and an elastic cord. The door frame defines a frame opening and a jamb at one side of the frame opening. The jamb includes two frame corners protruding into the frame opening and a jamb brace connecting the two frame corners across the frame opening. The jamb brace defines two spaced-apart hinge holes therethrough. The door is movable in order to selectively provide access through the frame opening. The door comprises two broad side surfaces that are connected by the door edges, including a jamb edge. The door defines two corner recesses configured to receive the two protruding frame corners of the jamb. The door further defines two hinge passages, each hinge passage extending from the jamb edge to a respective passage opening at one of the broad side surfaces of the door. The elastic cord connects the door to the door frame. The cord extends sequentially through a first of the two hinge passages, through a first of two passage openings at the jamb edge, through a first of the two hinge holes, across the jamb brace, through a second of the two hinge holes, through a second of the two passage openings at the jamb edge, and through the second of the two hinge passages.

In some embodiments, the corner recesses receiving the two protruding frame corners of the jamb prevent the door from disconnecting from the door frame upon impact.

In some examples, the hinge passages allow a relief for the elastic cord to move between an open door position and a closed door position.

In some cases, a first end and a second end of the elastic cord are secured to the door and held in position by a first knot and a second knot.

In some arrangements, the first knot and the second knot are hidden inside the passage openings at one of the broad surfaces of the door.

In some embodiments, the passage openings at one of the broad side surfaces of the door are smaller than the diameter of the first knot and the second knot.

In some cases, a first end and a second end of the elastic cord are secured to the door and held in position by an adhesive.

In some arrangements, the elastic cord is in a tensioned state when the door is in a closed or open position.

In some examples, the elastic cord facilitates a pivotal motion of the door about a hinge axis.

In some cases, the door defines a number of hinge passages ranging from two to five.

In some examples, the jamb brace defines a number of hinge holes ranging from two to five.

Various embodiments of the present disclosure relate to door hinge assemblies preferably intended for use by infants of age three and under. More specifically, embodiments include door hinge assemblies featuring parts of size and composition that do not pose a choking, aspiration, or ingestion hazard to children under three years old during use. The door hinge assemblies of the present disclosure are therefore designed to be approved for use e.g., in the United States and European Union (per the 16 Code of Federal Regulations (C.F.R.) Part 1501 and The Toy Safety Directive 2009/48/EC, respectively). For example, the door hinge assembly featured in certain embodiments can be manufactured without conventional door hinges that may produce small parts (as defined by 16 C.F.R. Part 1501) during normal use. Furthermore, certain embodiments provide door hinge assemblies that can be assembled (and disassembled) without special tools or fasteners. Still further embodiments provide door hinge assemblies that are capable of withstanding foreseeable use, damage, or abuse by children, such as impact of the door hinge assembly onto an impact medium (e.g., a ground surface).

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
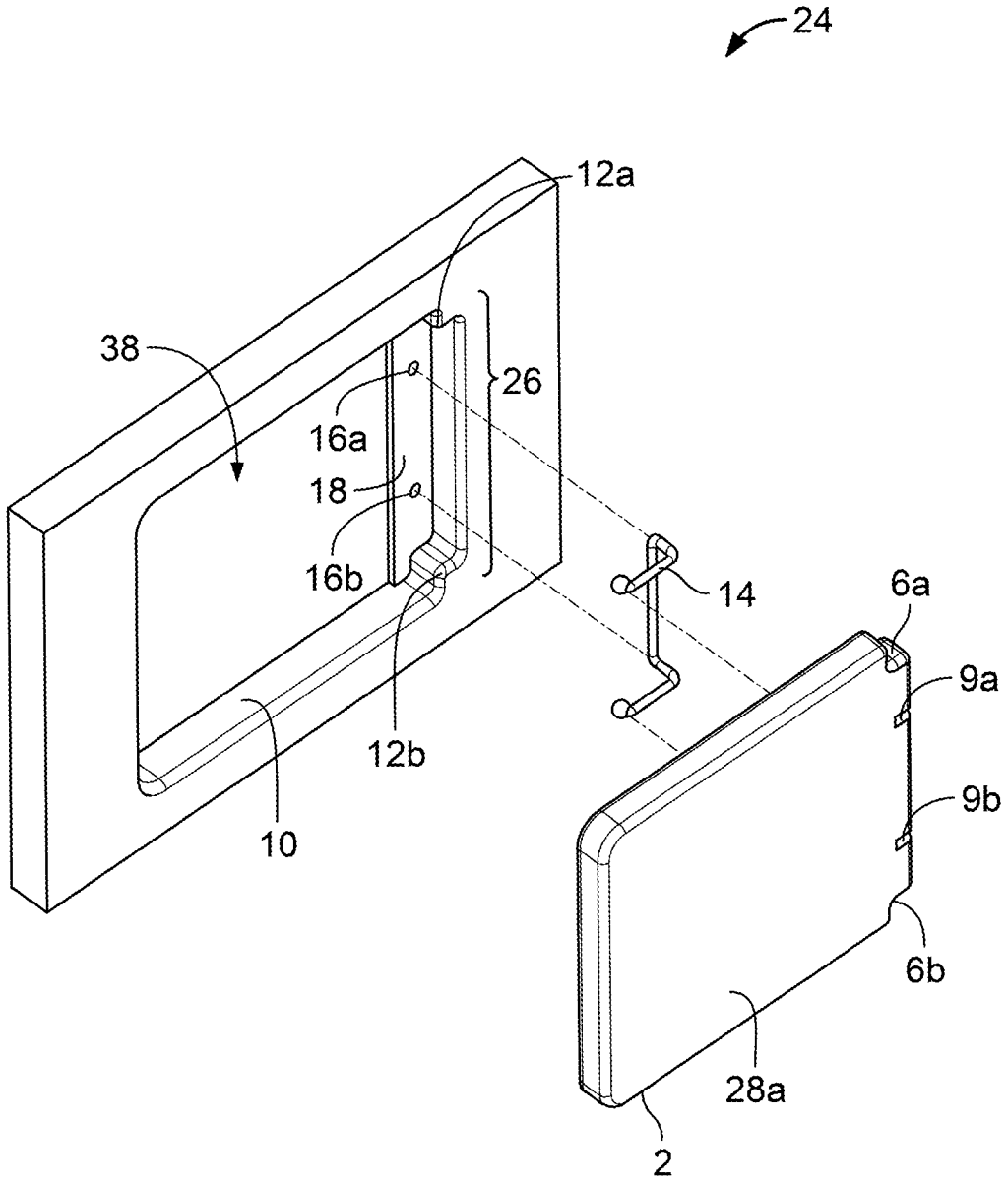
FIG. 1 is an exploded, perspective view of the door hinge assembly.

FIG. 1 shows an exploded view of a door hinge assembly 24 that includes a door frame 10, a door 2, and an elastic cord 14. Door frame 10 defines a frame opening 38 and a jamb 26 located at one side of the frame opening 38. In this example, door frame 10 is rectangular in shape; however, door frame 10 can be, for example, a square, circular, triangular, or any other suitable geometric-shaped door frame. Jamb 26 is the vertical portion of door frame 10 onto which door 2 is secured. Jamb 26 can be located at any side of the frame opening 38. Jamb 26 includes two frame corners 12*a* and 12*b* protruding into the frame opening 38. Frame corners 12*a* and 12*b* may have a square or rounded edge. Jamb 26 further includes a jamb brace 18. Jamb brace 18 connects the two frame corners 12*a* and 12*b* across the frame opening 38. Jamb brace 18 defines two spaced-apart hinge holes 16*a* and 16*b*. In some examples, jamb brace 18 defines a number of hinge holes ranging from two to five.

Door 2 is movable to selectively provide access through the frame opening 38. Door 2 can be a rectangular, square, circular, triangular, or any other suitable geometric-shaped door. Door 2 can be made of wood, plastic, metal, or any other suitable material that provides durability. Door 2 may selectively provide access to a box, a toy, or an article intended for use by children, for example. Door 2 defines two corner recesses 6*a* and 6*b* and two door recesses 9*a* and 9*b*.

Figure 2:
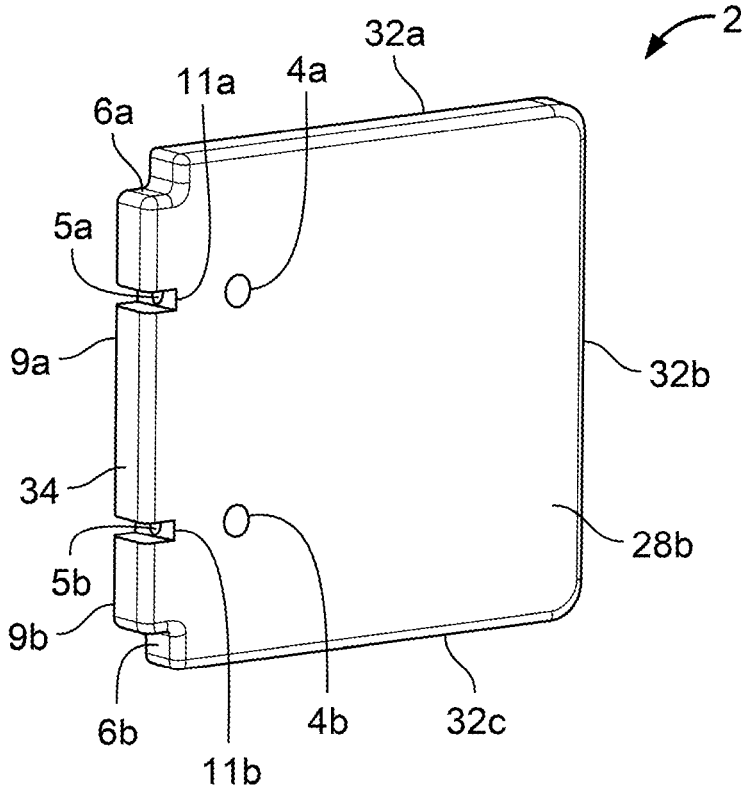
FIG. 2 is a back view of a door.

Referring to FIG. 2, door 2 comprises two broad side surfaces 28*a* (shown in FIG. 1) and 28*b*. Broad side surfaces 28*a* and 28*b* are connected by door edges 32*a*, 32*b*, and 32*c* including a jamb edge 34. Corner recesses 6*a* and 6*b* are configured to receive the two protruding frame corners 12*a* and 12*b*. Each door recess 9*a* and 9*b* extends from a jamb edge 34 to walls 11*a* and 11*b*, respectively. Walls 11*a* and 11*b* define passage openings 5*a* and 5*b*. Door 2 further defines two hinge passages 8*a* and 8*b* (not shown in FIG. 2). Each hinge passage extends from the jamb edge 34, more specifically from passage openings 5*a* and 5*b*, to respective passage openings 4*a* and 4*b* at the broad side surface 28*b* of the door 2. Hinge passages 8*a* and 8*b* allow a relief for elastic cord 14 to move between an open door position and a closed door position. In some examples, door 2 defines a number of hinge passages ranging from two to five.

Doors and door hinge assemblies found in childhood toys and products are often exposed to mechanical impact as part of the normal or reasonable foreseeable use by children. Mechanical impact on door hinges often causes the door to become disconnected from the door hinge and/or door frame.

The door hinge assemblies of the present disclosure are capable of withstanding an impact (i.e., a high force or shock applied over a short period of time when the door hinge assembly and a second body collide) without undergoing disassembly. The second body that may collide with the door hinge assembly can be an impact medium such as a solid surface. Non-limiting examples of the solid surface include a ground surface, a tile surface, a carpeted surface, and a concrete surface. Furthermore, the impact medium may be a wall or an object comprising a solid surface. The door hinge assemblies described herein may undergo an impact due to damage and/or abuse by children, for example. The door hinge assemblies of the disclosure have a high impact resistance. In other words, door hinge assembly 24 resists mechanical impact without undergoing physical damage (e.g., disassembly). For example, door hinge assembly 24 can remain assembled (i.e., door 2 connected to door frame 10 via elastic cord 14) after it collides with a solid surface.

Corner recesses 6*a* and 6*b* prevent door 2 from disconnecting from door frame 10 upon mechanical impact when both corner recesses 6*a* and 6*b* are receiving the two protruding frame corners 12*a* and 12*b* of the jamb 26. The connections between corner recesses 6*a* and 6*b* and the two protruding frame corners 12*a* and 12*b* act as reinforcement points that enable door 2 to remain connected to door frame 10 if, for example, the mechanical impact exerts a force on a top edge 32*a*, side edge 32*b*, bottom edge 32*c*, jamb edge 34, or either one of the broad side surfaces of door 2. In some examples, the connections between corner recesses 6*a* and 6*b* and the two protruding frame corners 12*a* and 12*b* absorb the shock of impact forces exerted on a component of the door hinge assembly 24.

Passage openings 5*a* and 5*b* at the jam edge 34 may be circular, as shown in FIG. 2, or rectangular in shape, for example. In this embodiment, passage openings 4*a* and 4*b* extend through broad side surface 28*b* but do not extend through broad side surface 28*a*. In this case, passage openings 4*a* and 4*b* are circular openings, but may be rectangular, square, triangular, on any other suitable geometric shape.

Figure 3:
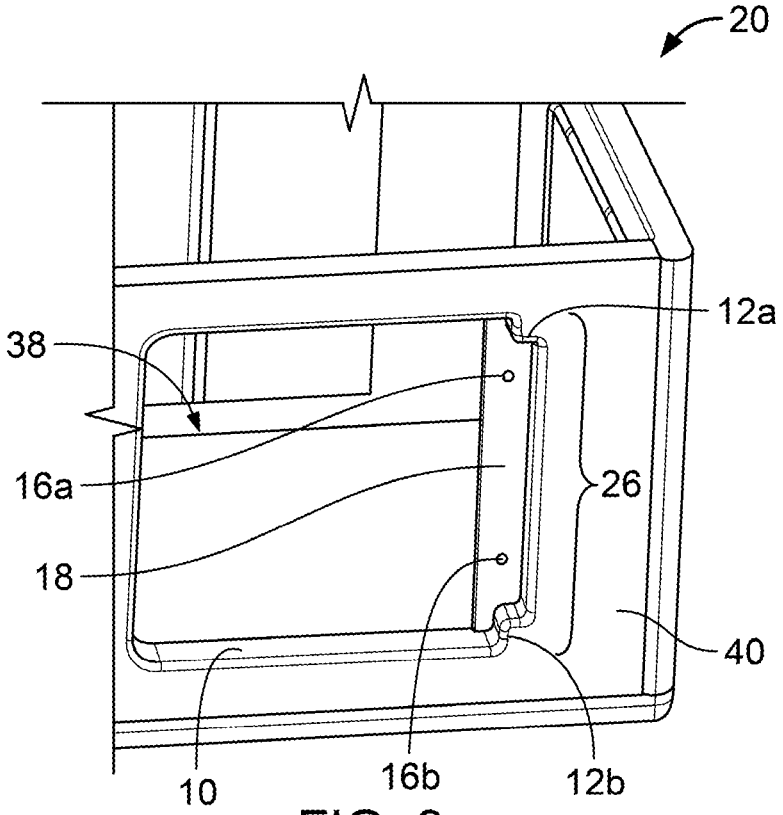
FIG. 3 is a front view of a door frame and jamb.

FIG. 3 depicts a box 20 comprising side surface 40. Side surface 40 comprises door frame 10. Door frame 10 further defines frame opening 38. Box 20 may be a toy or an article for use by children. In some examples, children using box 20 may be three years old or under. In some cases, persons using box 20 may be three years old or over. Box 20 may be composed of plastic, wood, metal, or any other suitable material. In yet another example, box 20 can be a furniture box or a decorative box.

Figure 4:
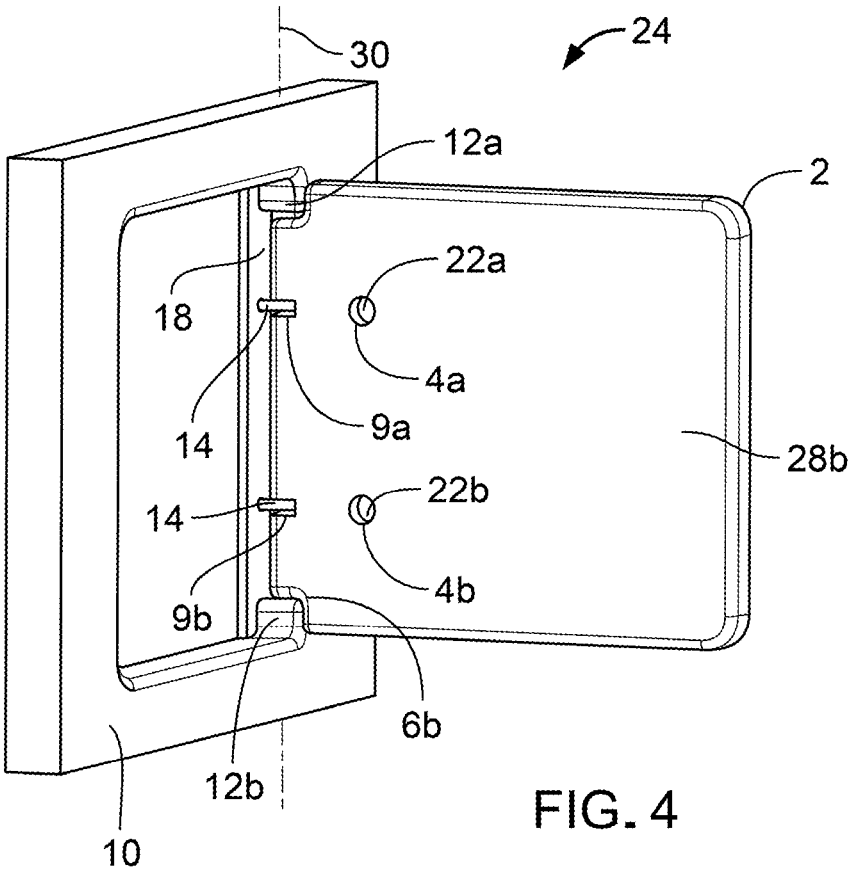
FIG. 4 is a perspective view of the door hinge assembly.

FIG. 4 illustrates door hinge assembly 24 in a fully assembled state with door 2 open. Jamb 26 (not shown in FIG. 4) and jamb brace 18 support door 2 for rotation about a hinge axis 30. In other words, elastic cord 14 facilitates a pivotal motion of door 2 about the hinge axis 30. Hinge axis 30 extends substantially parallel to jamb brace 18, as shown in FIG. 4. Jamb 26 and jamb brace 18 bear the weight of door 2 through elastic cord 14. Thus, elastic cord 14 serves as a door hinge by connecting door frame 10 to door 2 and allowing door 2 to have a limited angle of rotation about hinge axis 30. Elastic cord 14 extends through door recesses 9*a* and 9*b*, as shown in FIG. 4. Elastic cord 14 may be a braided elastic cord. Elastic cord 14 may be composed of polyester, textured polyester, cotton, nylon, polypropylene, glazed cotton, neoprene rubber, latex rubber, or any combination thereof.

The ends 22*a* and 22*b* of elastic cord 14 sit within passage openings 4*a* and 4*b* at the broad side surface 28*b* of the door 2. Ends 22*a* and 22*b* of elastic cord 14 can be secured to door 2 and can be held in position by a knot. In other words, elastic cord 14 can comprise knotted end tips. In some examples, the two ends 22*a* and 22*b* of the elastic cord 14 are secured to door 2 and held in position by an adhesive. In some embodiments, the two ends 22*a* and 22*b* of elastic cord 14 are tied to each other with a knot (not shown in the figures) in order to secure elastic cord 14. In some embodiments, elastic cord 14 comprises one knot. In some embodiments, elastic cord 14 comprises two knots. In some embodiments, the knot has a diameter that is greater than the diameter of passage openings 4*a* or 4*b*.

In other arrangements, a bead (not shown in the figures) is tied to each of the two ends 22*a* and 22*b* of elastic cord 14 in order to secure the two ends 22*a* and 22*b* of elastic cord 14. The bead may be composed of plastic, metal, wood, or any other suitable material. In some embodiments, the bead has a diameter that is greater than the diameter of passage openings 4*a* or 4*b*. In some examples, a crimp piece (not shown in the figures), such as a crimp tube, is attached to each of the two ends 22*a* and 22*b* of elastic cord 14 to secure the ends to door 2 and be held in position. In some embodiments, the crimp piece increases the diameter of elastic cord 14 such that the increased diameter of the elastic cord 14 comprising the crimp piece is greater than the diameter of passage openings 4*a* or 4*b*.

In yet another embodiment, a toggle wing fastener (not shown in the figures) is attached to each of the two ends 22*a* and 22*b* of elastic cord 14 to secure the ends to door 2 and be held in position. The toggle wing fastener can comprise toggle wing members that are in a radially expanded position at rest. The toggle wing members can be moved into a radially contracted position upon exertion of a force against the toggle wing members. For example, the toggle wing members are contracted upon insertion of the toggle wing fastener into passage openings 4*a* or 4*b*. In some embodiments, the toggle wing fastener, comprising toggle wing members in a contracted state, has a diameter that is less than the diameter of passage openings 4*a* or 4*b*. Upon insertion through passage openings 4*a* and 4*b*, the toggle wing members move to a radially expanded position thereby securing the two ends 22*a* and 22*b* of elastic cord 14 to door 2.

Figure 5:
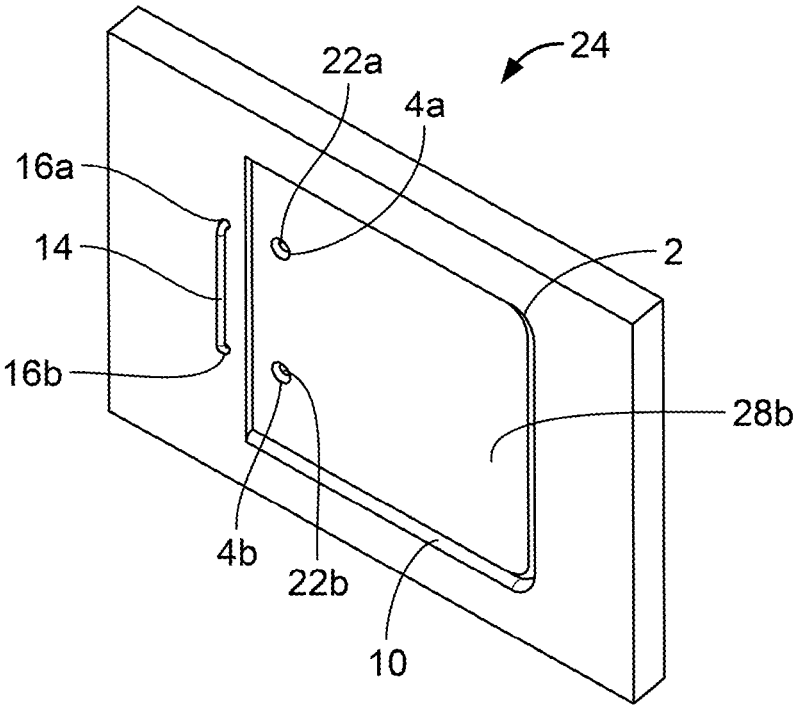
FIG. 5 is a back view of the door hinge assembly.

FIG. 5 shows a back view of door hinge assembly 24 in a fully assembled state with door 2 closed. Elastic cord 14 extends across the back side surface of jamb brace 18, through hinge holes 16*a* and 16*b*, as shown in FIG. 5. Hinge holes 16*a* and 16*b* are aligned vertically along the length of jamb brace 18. Furthermore, hinge holes 16*a* and 16*b* are aligned horizontally with passage openings 4*a* and 4*b* at the broad side surface 28*b* of the door 2, as shown in FIG. 5.

Figure 6:
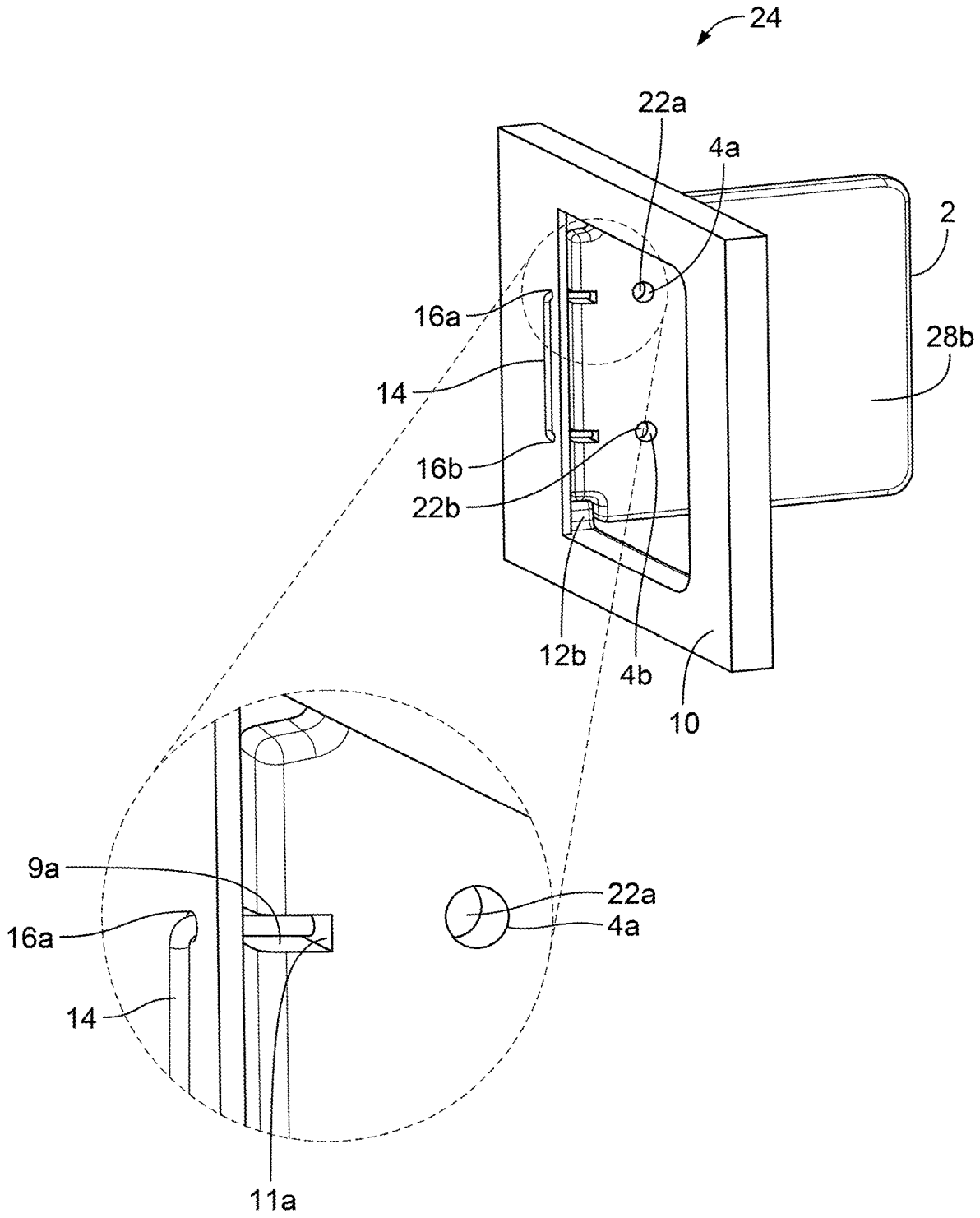
FIG. 6 is a back view of the door hinge assembly further illustrating details of the elastic hinge in a magnified portion.

FIG. 6 illustrates the connection of elastic cord 14 with door frame 10 and door 2 in more detail. Elastic cord 14 is in a tensioned state when the door is in a closed or open position. In operation, door hinge assembly 24 can be installed as follows. Elastic cord 14 extends sequentially through a first of the two hinge passages 8*a* and 8*b* (not shown in FIG. 6) and through a first of two passage openings 5*a* and 5*b* (not shown in FIG. 6) at walls 11*a* and 11*b* located at jamb edge 34. Next, elastic cord 14 extends through a first of two door recesses 9*a* and 9*b*. Then, elastic cord 14 extends sequentially through a first of the two hinge holes 16*a* and 16*b* and across the jamb brace 18. Next, elastic cord 14 extends sequentially through a second of the two hinge holes 16*a* and 16*b*, through the first of two door recesses 11*a* and 11*b*, and through a second of the two passage openings 5*a* and 5*b* at jamb edge 34. Lastly, elastic cord 14 extends through the second of the two hinge passages 8*a* and 8*b*.

Figure 7A:
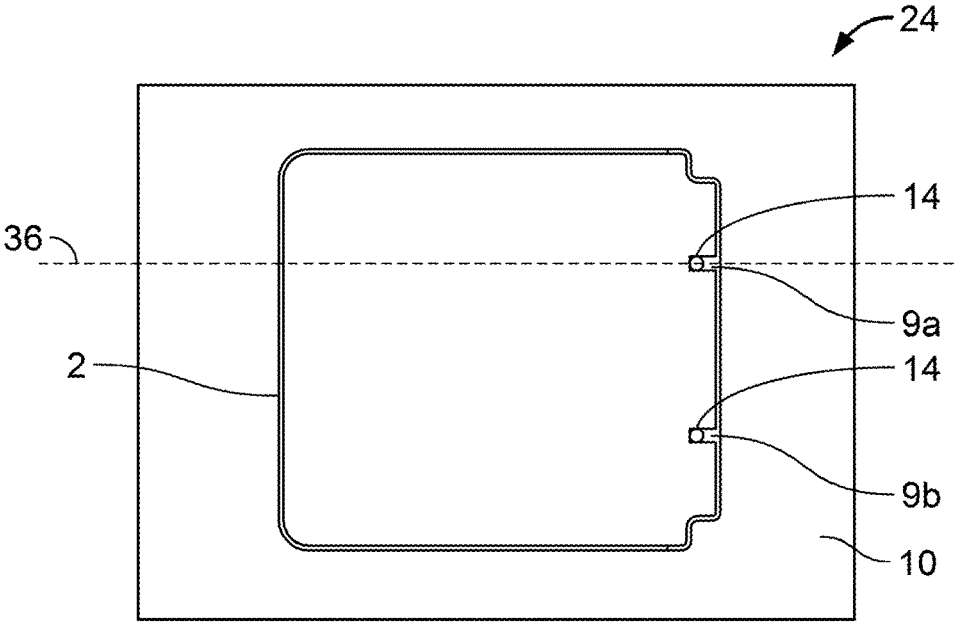
FIG. 7A is a front view of the door hinge assembly.
Figure 7B:
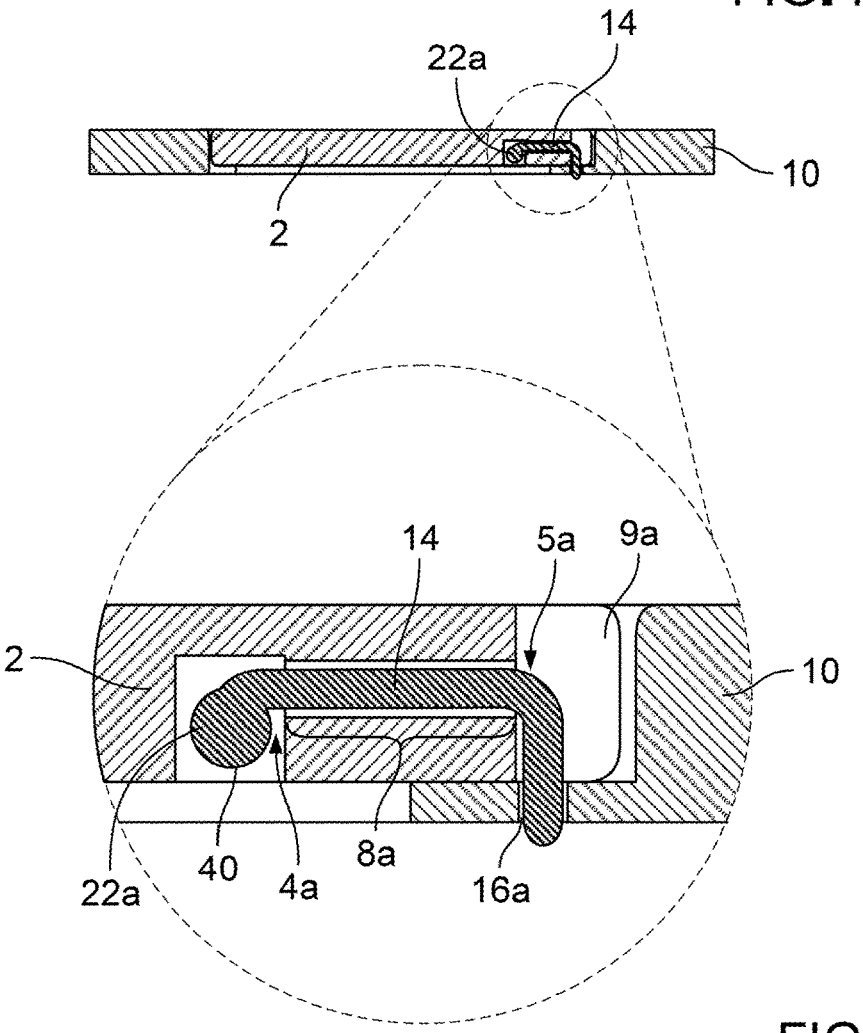
FIG. 7B is a cross-sectional view of the door, door frame, and elastic cord, as shown in FIG. 7A.

Referring next to FIGS. 7A and 7B, FIG. 7B is a cross-section on line 36 of FIG. 7A. FIG. 7B illustrates the position of elastic cord 14 when door 2 is in a closed position, as shown in FIG. 7A. One of the two ends 22*a* of elastic cord 14 sits within one of the two passage openings 4*a* at one of the broad surfaces of door 2. FIG. 7A further illustrates one of the two ends 22*a* as comprising a knot 42 such that knot 42 prevents the elastic cord 14 from sliding through one of the hinge passages 8*a*. In some embodiments, knot 42 at the two ends 22*a* and 22*b* of the elastic cord 14 prevents the elastic cord 14 from sliding through one of the hinge holes 16*a* and 16*b*. In some examples, passage openings 4*a* and 4*b* at one of the broad side surfaces of door 2 are smaller than the diameter of knot 42 at the two ends 22*a* and 22*b* of the elastic cord 14. In some cases, passage openings 5*a* and 5*b* at jamb edge 34 are smaller than the diameter of knot 42 at the two ends 22*a* and 22*b* of the elastic cord 14. In some cases, hinge holes 16*a* and 16*b* are smaller than the diameter of knot 42 at the two ends 22*a* and 22*b* of the elastic cord 14. In some arrangements, the two ends 22*a* and 22*b* of the elastic cord 14 are knotted after the elastic cord 14 is installed, as previously described. In some cases, the two ends 22*a* and 22*b* of the elastic cord 14 are hidden inside passage openings 4*a* and 4*b* at one of the broad surfaces of door 2.

Figure 8:
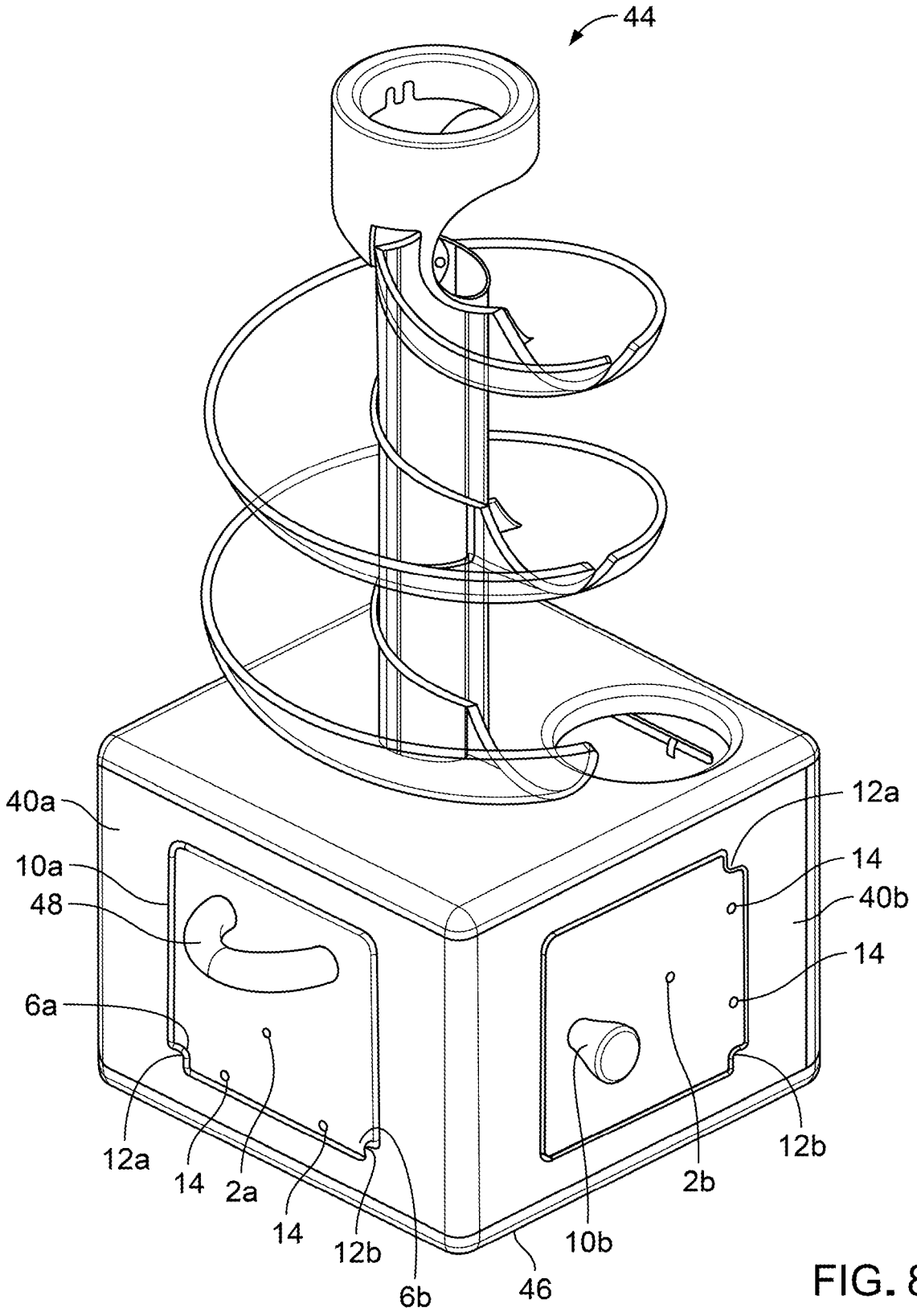
FIG. 8 is a perspective view of a toy comprising the door hinge assembly.

FIG. 8 illustrates a childhood toy 44 comprising the door hinge assemblies of the disclosure. Childhood toy 44 comprises side surfaces 40*a* and 40*b*. Side surface 40*a* comprises a door frame 10*a* that further defines a frame opening. Door 2*a* is attached to door frame 10*a* via elastic cord 14. Similarly, side surface 40*b* comprises a door frame 10*b* that further defines a frame opening. Door 2*b* is attached to door frame 10*b* via elastic cord 14. Doors 2*a* and 2*b* are illustrated in a closed position with corner recesses 6*a* and 6*b* receiving the two protruding frame corners 12*a* and 12*b*. Door 2*a* comprises a door handle 48. Door 2*b* comprises a door knob 46. In some examples, door 2 and door frame 10 further comprise one or more magnets each, configured to serve as a magnetic door closure. In some cases, door 2 further defines an opening (not shown in the figures), extending through both of the broad side surfaces 28*a* and 28*b*, which serves as door opening mechanism. For example, a child can place a hand through the opening of door 2 while door 2 is in a closed position and further open door 2 by grabbing an edge of the opening and pulling door 2 open.

While a number of examples have been described for illustration purposes, the foregoing description is not intended to limit the scope of the invention, which is defined by the scope of the appended claims. There are and will be other examples and modifications within the scope of the following claims.

What is claimed is:

1. A door hinge assembly, comprising:

a door frame defining a frame opening and a jamb at one side of the frame opening, the jamb including two frame corners protruding into the frame opening and a jamb brace connecting the two frame corners across the frame opening, the jamb brace defining two spaced-apart hinge holes therethrough;

a door movable to selectively provide access through the frame opening, the door comprising two broad side surfaces connected by door edges including a jamb edge, the door defining:

two corner recesses configured to receive the two protruding frame corners of the jamb; and two hinge passages, each hinge passage extending from a respective passage opening at the jamb edge to a respective passage opening at one of the broad side surfaces of the door; and an elastic cord connecting the door to the door frame, the cord extending sequentially through a first of the two hinge passages, through a first of the two passage openings at the jamb edge, through a first of the two hinge holes, across the jamb brace, through a second of the two hinge holes, through a second of the two passage openings at the jamb edge, and through the second of the two hinge passages.

2. The door hinge assembly of claim 1, wherein the corner recesses receiving the two protruding frame corners of the jamb prevent the door from disconnecting from the door frame upon impact.

3. The door hinge assembly of claim 1, wherein the hinge passages allow a relief for the elastic cord to move between an open door position and a closed door position.

4. The door hinge assembly of claim 1, wherein a first end and a second end of the elastic cord are secured to the door and held in position by a first knot and a second knot.

5. The door hinge assembly of claim 4, wherein the first knot and the second knot are hidden inside the passage openings at one of the broad side surfaces of the door.

6. The door hinge assembly of claim 5, wherein the passage openings at one of the broad side surfaces of the door are smaller than a diameter of the first knot and the second knot.

7. The door hinge assembly of claim 1, wherein a first end and a second end of the elastic cord are secured to the door and held in position by an adhesive.

8. The door hinge assembly of claim 1, wherein the elastic cord is in a tensioned state when the door is in a closed or open position.

9. The door hinge assembly of claim 1, wherein the elastic cord facilitates a pivotal motion of the door about a hinge axis.

* * * * *